United States Patent [19]

Ward

[11] 4,056,959

[45] Nov. 8, 1977

[54] APPARATUS FOR CONVEYING HEATED ROD

[75] Inventor: George C. Ward, Carrollton, Ga.

[73] Assignee: Southwire Company, Carrollton, Ga.

[21] Appl. No.: 520,268

[22] Filed: Nov. 4, 1974

[51] Int. Cl.[2] ..... B21B 45/02; B21F 3/00; B65H 17/32

[52] U.S. Cl. ..... 72/128; 72/66; 72/201; 226/97; 266/112

[58] Field of Search ..... 72/66, 128, 201, 342, 72/202; 148/156; 266/45, 65, 112, 113; 226/7, 97; 243/38; 302/3 R, 31

[56] References Cited

U.S. PATENT DOCUMENTS

| | | | |
|---|---|---|---|
| 1,211,277 | 1/1917 | Bloom | 266/65 |
| 1,871,100 | 8/1932 | Walton et al. | 226/7 |
| 2,856,803 | 10/1958 | Fredriksson et al. | 72/201 |
| 2,971,683 | 2/1961 | Paulsen | 226/97 |
| 3,230,752 | 1/1966 | Dobson et al. | 226/97 |
| 3,395,560 | 8/1968 | Cofer et al. | 72/66 |
| 3,553,423 | 1/1971 | Doxey | 226/97 |
| 3,654,114 | 4/1972 | Brandstaetter | 226/7 |
| 3,738,148 | 6/1973 | Fuchs | 226/7 |
| 3,824,616 | 7/1974 | Uchida | 226/97 |

FOREIGN PATENT DOCUMENTS

| | | | |
|---|---|---|---|
| 1,569,259 | 5/1969 | France | 72/201 |
| 2,004,405 | 11/1969 | France | 72/201 |
| 1,071,315 | 6/1967 | United Kingdom | 72/201 |
| 265,922 | 6/1970 | U.S.S.R. | 72/201 |

*Primary Examiner*—E. M. Combs
*Attorney, Agent, or Firm*—Van C. Wilks; Herbert M. Hanegan; Stanley L. Tate

[57] ABSTRACT

Reducing or overcoming frictional drag on a rod moving through an enclosing tube by utilizing viscous drag of a liquid medium flowing through the tube in the direction of rod movement. Heated metallic rod moves through a hollow support tube leading from the output of a rolling mill to a mechanism for coiling the rod. The rod leaving the rolling mill is at an elevated temperature which places the rod in an extremely flexible state, so that the rod tends to become twisted within the tube to create "cobbles" or entanglements preventing further movement of the rod through the tube. The present apparatus and method, as applied to the disclosed embodiments of the invention, provide a flow of liquid medium through the tube in the direction of rod movement at a velocity sufficient to impart substantial force to the rod through the effect of viscous drag between the moving liquid medium and the rod. The amount of force imparted to the moving rod through viscous drag may be adjusted to be substantially equal to the frictional retarding force which would otherwise impede movement of the rod, or the amount of force may be adjusted to provide an increment of force tending to propel the rod in the forward direction through the tube. The liquid flowing through the tube may also perform additional functions, such as cooling and pickling the heated rod moving through the tube.

4 Claims, 3 Drawing Figures

APPARATUS FOR CONVEYING HEATED ROD

This invention relates in general to the reduction of friction drag, and in particular to a method and apparatus for reducing friction drag of a heated rod being conveyed from a rolling mill to a rod coiling mechanism.

The production of continuous rod made of material such as copper or aluminum, for example, includes the steps of continuously casting a bar in a continuous casting machine, passing the newly-cast bar through a rolling mill to hot-form the cast bar down to a rod having a diameter suitable for the manufacture of wire or other products, and then coiling the hot-formed rod in coils for storage and subsequent use. The continuous casting machine and the rolling mill are typically located contiguous to each other, so that the rolling mill receives cast bar which has just emerged from the continuous casting machine and which remains at an elevated temperature suitable for hot-forming. The rod emerges from the rolling mill at an elevated temperature, typically in excess of 1000° F. for copper rod and in excess of 700° F. for aluminum rod, causing the rod to be too soft and flexible to support its own weight. The rod must, accordingly, be supported and cooled while being conveyed from the rolling mill to a coiling mechanism. The rod exiting the rolling mill is typically supported and cooled in the prior art by propelling the heated rod through a hollow tube extending from the output end of the rolling mill to the coiling mechanism. A supply of water or another suitable liquid is pumped through the tube in a counter-flow direction which is the opposite of the direction of rod movement through the tube, and pinch rolls may be provided to engage the rod and assist its passage through the tube. An example of a continuous casting operation as described above is shown in U.S. Pat. No. 3,613,767 in the context of continuous casting of aluminum alloy, although those skilled in the art will realize that a similar arrangement is also used for continuous casting of copper rod as exemplified in U.S. Pat. No. 3,257,835. Further details of a liquid-cooled rod guide tube are shown in U.S. Pat. No. 3,395,560.

It has been found that the rod frequently becomes twisted or otherwise displaced from a nominal path of movement while passing through the tube leading from the rolling mill to the coiling mechanism, since the rod enters the tube in a plastic state resulting from elevated temperature of the rod. The moving rod may receive sufficient frictional force from sliding contact with the inner surface of the tube, for example, to retard the rod movement at one location within the tube while the rod is being continuously fed from the rolling mill into the tube at an unretarded speed, causing the rod to buckle somewhere within the tube. The effects of nonuniform rod velocity through the tube may be magnified by the aforementioned pinch rolls located between the ends of the tube, since the pinch rolls operate at a uniform speed which cannot accommodate transient fluctuations in rod velocity along the length of the tube. A momentary increase in rod velocity over the linear rate of pinch roll operation may cause a cobble to form upstream of the pinch roll, while a momentary decrease in rod velocity may cause the rod to become permanently elongated by the greater linear rate of the pinch roll. When the movement of rod through the tube becomes obstructed or impeded in some manner, the continuing input of heated flexible rod into the tube from the rolling mill only adds to the entanglement of rod within the tube and creates a condition which is commonly known as a "cobble" within the tube. Since it is generally unfeasible to prematurely interrupt a continuous rod casting operation, the rod emerging from the casting machine must, in the event of a cobble within the guide tube, be cut into sections and laid aside for subsequent melting and recasting. Furthermore, the length of cast bar within the rolling mill must be removed before the continuous rod manufacturing operation can recommence. The entire labor and material handling cost associated with a continuous casting run is completely lost, and it will be seen that the elimination of cobbles in a continuous casting operation is a highly desirable result.

A means of alleviating some of the adverse effects of cobbles in a rolling mill are discussed in U.S. Pat. No. 3,672,199, although those skilled in the art will appreciate that the cobble relief mechanisms disclosed in that patent are not readily applicable to relief of cobbles which may occur in the guide tube downstream from the rolling mill.

Accordingly, it is an object of the present invention to provide an improved method and apparatus for the manufacture of continuous metal rod.

It is another object of the present invention to provide a method and apparatus for reducing or preventing the formation of cobbles in the guide tube extending between a rolling mill and a coiling mechanism used in the production of metal rod.

It is another object of the present invention to provide a method and apparatus for reducing the amount of frictional drag on a rod moving through a guide tube.

It is yet another object of the present invention to provide a method and apparatus for imparting a slippable propulsive force to a movable rod.

Other objects and attendant advantages of the present invention will become more readily apparent from consideration of the following description of a disclosed embodiment, including the drawings in which.

Stated in general terms, it has been discovered that the counterflow movement of cooling liquid through the rod guide tube, occurring in a direction opposite to the direction of rod movement from the rolling mill to the coiling mechanism, imparts a frictional drag force to the rod which causes or aids in the causation of cobbles within the guide tube. This frictional drag force on the rod is a result of viscous drag occurring between the rod moving in a forward direction through the guide tube, and the counter flow of cooling liquid moving in the reverse or opposite direction through the guide tube containing the moving rod. It has also been discovered that moving the rod through the guide tube concurrently with a flow of liquid in the direction of rod movement not only eliminates the viscous drag friction heretofore encountered, but also imparts to the moving rod a forward viscous drag force in the direction of rod movement. The rate of flow of liquid in the forward direction within the guide tube can be adjusted to provide a forward viscous drag force having a magnitude which substantially equals the frictional drag forces tending to impede the movement of the rod through the tube, so that the net frictional force acting on the rod moving through the tube is approximately zero.

Figure 1:
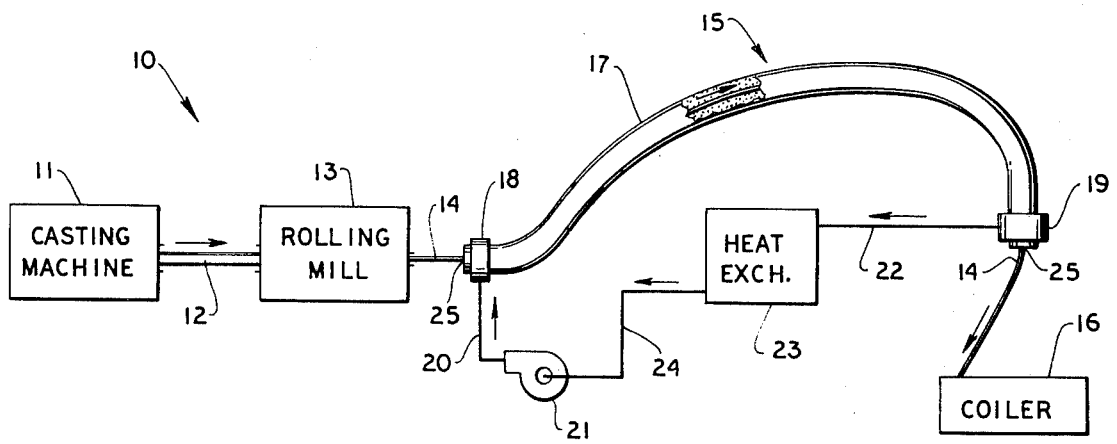
FIG. 1 shows a schematic elevation view of a continuous rod production facility including a viscous force guide tube according to a disclosed embodiment of the present invention.

The present invention is more readily understood with reference to the disclosed embodiment thereof as shown in FIG. 1, wherein there is shown a continuous rod casting operation indicated generally at 10 and including a continuous casting machine 11 operating in a conventional manner to supply a continuous length of cast bar 12 to a rolling mill 13. Both the casting machine 11 and the rolling mill 13 may be of conventional design and operation, and it will be understood that the rolling mill operates on the cast bar 12 to elongate the bar and reduce the cross-sectional area of the bar so that the bar emerges from the rolling mill as the continuous rod 14. The rod 14 passes through a guide tube indicated generally at 15 to be cooled and transported to a suitable coiling mechanism 16. Rod coiling mechanisms are known in the art and are not disclosed in detail herein.

The guide tube 15 in the embodiment depicted in FIG. 1 includes a continuous tube 17 of inner diameter substantially greater than the diameter of the rod 14 passing therethrough. Fluid flow couplings 18 and 19 are connected to the ends of the tube 17 adjacent the rolling mill and the coiling mechanism, respectively, for establishing fluid flow communication with the interior of the tube 17. The fluid coupling 18 is connected through a conduit 20 to the discharge side of a pump 21, while the coupling 19 is connected to the inlet of the pump by way of the conduit 22, the heat exchanger 23, and the conduit 24. The two ends of the tube 17 are each equipped with constricted openings 25, which allow the rod 14 to pass into and out of the tube with substantially no impeding friction while providing a substantial obstruction to the flow of liquid out of the tube. Since there should be substantially no contact between the rod 14 and the constricted openings 25, it is understood and accepted that some amount of pressurized liquid within the tube 17 may escape from the tube through the constricted openings 25 without adversely affecting the operation of the present invention. Of course, it will be necessary to provide make-up liquid to replace any liquid which escapes from the system in the foregoing manner.

Considering the operation of the embodiment shown in FIG. 1, it is assumed that the casting machine 11 and the rolling mill 13 are operating in a conventional manner to provide a continuous flow of rod 14 emerging from the rolling mill, and it is also assumed that the rod 14 has been disposed through the entire length of the conduit 17 and is being coiled by the coiling mechanism 16. The pump 21 is operating at this time to provide a flow of liquid in the direction shown by the arrows in FIG. 1, namely, entering the tube 17 by way of the fluid coupling 18, flowing along the entire length of the tube 17, and being withdrawn from the tube at the fluid coupling 19 for passage through the heat exchanger 23. The heat exchanger 23 is necessary in a closed-circuit liquid system to remove heat imparted to the coolant from contact with the heated rod 14 emerging from the rolling mill, although it will be understood that liquid flow through the tube 17 can alternatively be provided with an open-circuit system utilizing a continuous supply of cool liquid pumped into the tube.

The flow of liquid through the tube 17 in the direction of movement of the rod 14 provides a viscous drag force acting on the surface of the moving rod. The magnitude and vector direction of this viscous drag force is determined by such factors as the relative velocities of the moving rod and the liquid flow, and the viscosity of the liquid flowing through the tube. It will be appreciated, for example, that no viscous drag force is imparted to the rod if the flow rate of liquid moving through the tube in the direction of rod movement is identical to the rate at which the rod is being propelled through the tube. If the velocity of liquid flowing through the tube 17 in the forward direction, that is, the direction in which the rod 14 is moving, exceeds the velocity of rod movement, viscous drag force in the forward direction is imparted to the rod; the magnitude of the viscous drag force depends on the relative velocities of liquid and rod, among other factors. It will be understood that the viscous drag force imparted to the rod 14 in the forward direction is distributed along the entire length of the rod contained within the tube 17, so that the viscous drag force is applied to the rod in a manner tending to avoid the application of localized force which might otherwise impart nonuniform rod velocity causing the rod to become cobbled within the tube. The effect of the forward viscous drag force on the rod can be likened to a distributed pinch roller effect extending along the length of the tube.

It will be appreciated that the flow rate of liquid moving in the forward direction through the tube 17 can be increased to a level whereat the resulting forward viscous drag force imparted to the rod 14 within the tube is substantially equal to the frictional drag force which impedes the forward movement of the rod through the tube. When this level of forward viscous drag force is reached, the movement of rod through the tube can be said to be substantially frictionless. A further increase in the forward viscous drag force imparts to the rod a net viscous drag force tending to urge or propel the rod through the tube, and this viscous drag propulsion may be particularly useful to thread the rod through the tube at the beginning of a production run of continuous rod.

It will be understood that the flow of liquid in the forward direction through the tube 17 also accomplishes cooling of the heated rod 14 emerging from the rolling mill, and so either the heat exchanger 23 is required to extract heat from the liquid withdrawn at the fluid coupling 19 of the tube 17 in the closed-circuit system of FIG. 1. Those skilled in the art will recognize that various chemical compositions may be added to the liquid recirculating through the tube 17, to remove scale from the heated rod 14 or for other purposes not related to the present invention.

Figure 2:
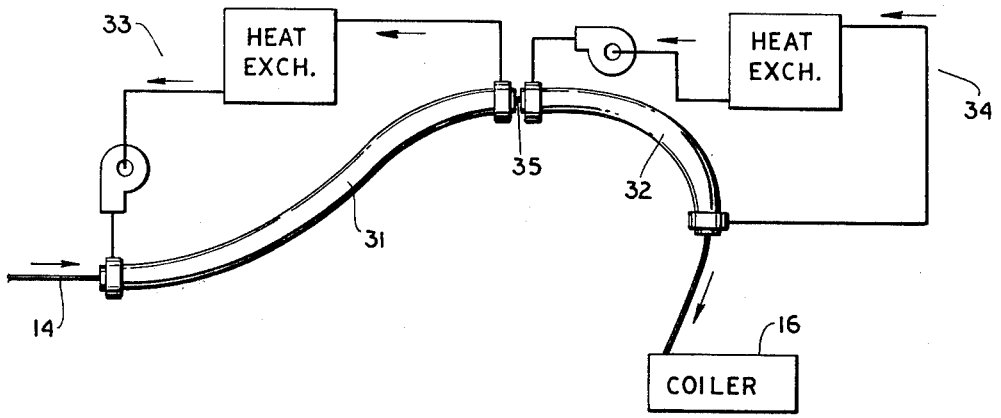
FIG. 2 shows a partial schematic view of viscous force guide tube arrangement for providing plural forces according to an alternative disclosed embodiment of the invention.

FIG. 2 shows an alternative embodiment of the present invention wherein the movement path of the rod extending from the rolling mill to the coiling mechanism is defined by two separate guide tubes 31 and 32. Each of the guide tubes 31 and 32 is provided with a separate liquid recirculation system indicated at 33 and 34, respectively, to provide a forward-directed flow of liquid through the respective guide tubes. The guide tube 31 is positioned to receive the rod 14 being propelled from the rolling mill, and conducts the rod to a location 35 where the rod exits the guide tube 31 and enters the guide tube 32. The soft rod 14 entering the guide tube 31 from the rolling mill may be moved in a path which is relatively straight or which includes only large-radius bends, so as to minimize the occurrence of cobbles at a time when the rod is hottest and softest. The rod is considerably cooler upon entering the guide tube 32, however, and so the guide tube 32 may include a shorter-radius bend as required to align the rod with the input of the coiling mechanism 16. It will also be apparent that the recirculation system 33 and 34 associated with the two guide tubes 31 and 32 can be operated to provide different viscous drag forces on the rod, if desired.

Figure 3:
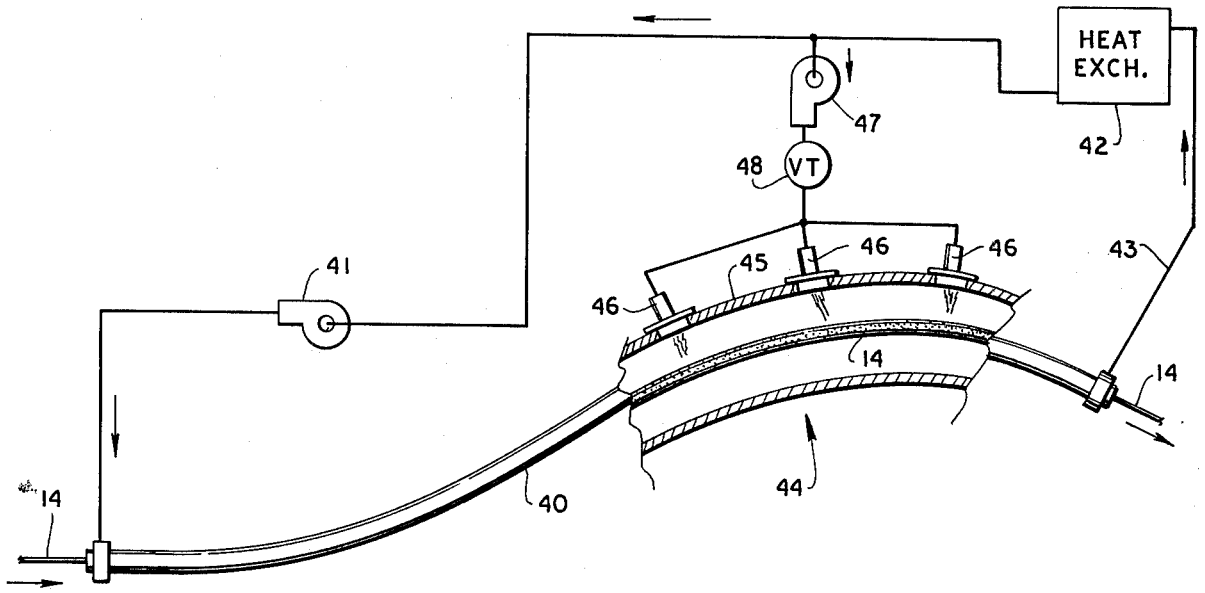
FIG. 3 shows a schematic elevation view, partly broken away and enlarged for descriptive purposes, of still another embodiment of the present invention.

Turning next to FIG. 3, there is shown still another embodiment of the present invention in which liquid flow is used to deflect a moving rod in the direction of curvature of a tube 40. The tube 40 is provided with a liquid recirculation system including the pump 41, the heat exchanger 42, and the liquid return line 43, all of which function as described above to provide viscous drag force acting in the forward direction on the rod 14 being propelled into the guide tube 40 from a rolling mill. The guide tube 40 has a curved portion 44 which is shown in enlarged and broken-away detail in FIG. 3, although it will be understood that the curved portion 44 of an actual guide tube 40 has the same diameter as the remainder of the guide tube. The wall 45 forming the outside radius along the curved portion 44 of the guide tube contains a number of apertures through which injectors 46 are disposed in communication with the interior of the guide tube. Each of the injectors 46 is connected through the throttle valve 48 to the discharge side of a pump 47, which is connected to receive a supply of liquid. The injectors 46 are aligned to direct streams of liquid in a direction toward the rod 14 moving through the curved portion 44, so that the liquid flowing from the injectors will exert on the rod a force tending to deflect the moving rod away from a nominal straight-line path to assume a radius of curvature which is comparable to the radius of the curved portion 44. The liquid streams emanating from the injectors 46 may impart deflecting forces on the rod 14 resulting from viscous drag and also from direct impingement on the rod. It may be desirable to provide injectors 46 which direct a fan-shaped jet of water across substantially the cross-section area of the curved portion 44, inasmuch as it cannot be assumed that the rod 14 will be centrally positioned within the guide tube 40.

It will be understood that the foregoing relates only to disclosed embodiments of the present invention, and that numerous modifications and changes may be made therein without departing from the spirit and the scope of the invention as defined in the following claims.

What is claimed is:

1. Apparatus for conveying heated flexible metal rod continuously emitting from a rolling mill into a coiling means, comprising an elongated guide tube having an inlet end for receiving the rod from the rolling mill, an exit end through which the rod is delivered to the coiling means and a curved portion through which the direction of travel of the rod is changed from a substantially straight upwardly inclined path into an arcuate path prior to emitting from said exit end, a liquid recirculation system for conveying a cooling liquid through said tube in the direction of rod travel therethrough, and wherein said liquid recirculation system includes a plurality of fluid injector means spaced over a substantial segment of said curved portion of said tube for directing jets of liquid into said tube, said injector means being positioned to direct said jets both to deflect the rod in the direction of curvature of said curved portion so as to prevent the rod from contacting any portion thereof, and to impart a viscous drag force on the rod in the direction of rod travel whereby the rod is conveyed through said guide tube with a minimum of friction.

2. Apparatus as defined in claim 1, wherein said fluid injector means are positioned on the outside radius of said curved tube portion and extend through the wall thereof to inject said jets of liquid into said tube at an angle to the nominal path of rod travel therethrough.

3. Apparatus as defined in claim 1, wherein said liquid recirculation system includes means for maintaining liquid flow through said guide tube at a rate of flow which imparts viscous drag force on the rod substantially equal in magnitude to the frictional force tending to impede movement of the rod through said guide tube.

4. Apparatus as defined in claim 3, wherein said means for maintaining liquid flow includes a liquid supply line for supplying liquid to the inlet end of said guide tube, a return line for withdrawing liquid from the exit end of said guide tube and pump means connecting said supply line and said return line.

* * * * *